US010584864B2

(12) United States Patent
Blake et al.

(10) Patent No.: US 10,584,864 B2
(45) Date of Patent: Mar. 10, 2020

(54) DOWNLIGHT LIGHTING ASSEMBLY

(71) Applicant: Focal Point, LLC, Chicago, IL (US)

(72) Inventors: Johanna Blake, Chicago, IL (US); James Cullen, Northbrook, IL (US); Walter Mayorga, Frankfort, IL (US); Edwin Vice, Jr., Chicago, IL (US); Ken Czech, Naperville, IL (US)

(73) Assignee: Focal Point, LLC, Chicago, IL (US)

( * ) Notice: Subject to any disclaimer, the term of this patent is extended or adjusted under 35 U.S.C. 154(b) by 0 days.

(21) Appl. No.: 15/682,172

(22) Filed: Aug. 21, 2017

(65) Prior Publication Data

US 2019/0056098 A1 Feb. 21, 2019

(51) Int. Cl.

| | |
|---|---|
| ***F21V 29/77*** | (2015.01) |
| ***F21S 8/02*** | (2006.01) |
| ***F21V 19/00*** | (2006.01) |
| ***F21V 5/04*** | (2006.01) |
| ***F21V 17/14*** | (2006.01) |
| ***F21V 21/04*** | (2006.01) |
| ***F21Y 115/10*** | (2016.01) |

(52) U.S. Cl.

CPC ..... *F21V 29/773* (2015.01); *F21S 8/026* (2013.01); *F21V 5/04* (2013.01); *F21V 17/14* (2013.01); *F21V 19/002* (2013.01); *F21V 19/003* (2013.01); *F21V 21/04* (2013.01); *F21V 21/044* (2013.01); *F21Y 2115/10* (2016.08)

(58) Field of Classification Search

CPC ..... F21V 29/00; F21V 29/002; F21V 29/006; F21V 29/02

USPC ..... 362/294, 257, 264

See application file for complete search history.

(56) References Cited

U.S. PATENT DOCUMENTS

| | | | | |
|---|---|---|---|---|
| 2010/0259919 | A1* | 10/2010 | Khazi | F21S 8/026 362/84 |
| 2011/0063849 | A1* | 3/2011 | Alexander | F21V 19/001 362/294 |
| 2011/0075414 | A1* | 3/2011 | Van De Ven | F21V 15/01 362/235 |
| 2012/0106176 | A1* | 5/2012 | Lopez | F21K 9/00 362/382 |
| 2012/0224375 | A1* | 9/2012 | Zaderej | F21K 9/00 362/249.02 |
| 2013/0114260 | A1* | 5/2013 | Lopez | F21V 29/02 362/249.02 |
| 2014/0103796 | A1* | 4/2014 | Jansen | F21V 7/041 313/498 |
| 2015/0276141 | A1* | 10/2015 | White | F21V 29/70 362/147 |
| 2016/0040863 | A1* | 2/2016 | Beck | F21V 17/105 362/365 |

* cited by examiner

*Primary Examiner* — Edwyn Labaze
(74) *Attorney, Agent, or Firm* — Banner & Witcoff, Ltd.

(57) ABSTRACT

A downlight lighting assembly comprising a plurality of notches and engaging members to ease the alignment and assembly of the components. The downlight lighting assembly comprises an LED chip removably connected to a heatsink with a mixing chamber secured to the heatsink, where securing the mixing chamber to the heatsink provides the compressive force for an LED connector to engage and provide the electrical connection to the LED chip. The heatsink also has a plurality of protrusions on its upper edge to engage a lower wall of a reflector to secure the reflector to the lighting assembly.

20 Claims, 10 Drawing Sheets

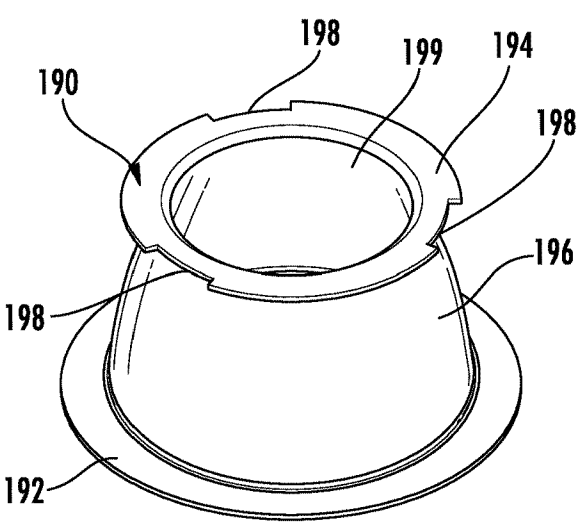
FIG. 10A
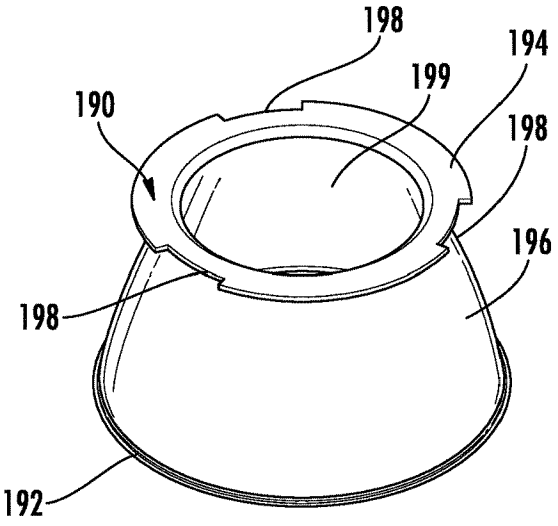
FIG. 10D
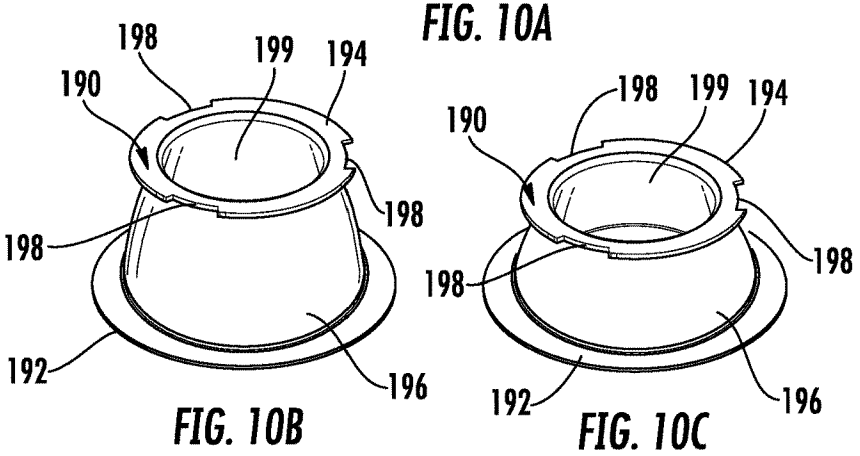
FIG. 10B
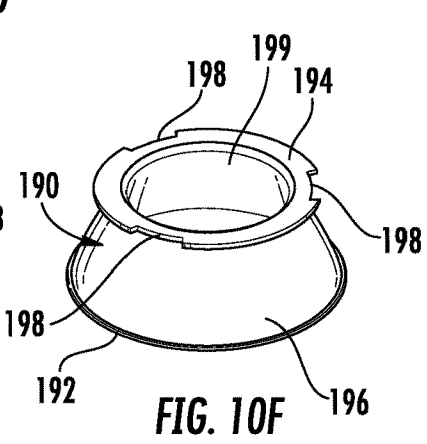
FIG. 10C
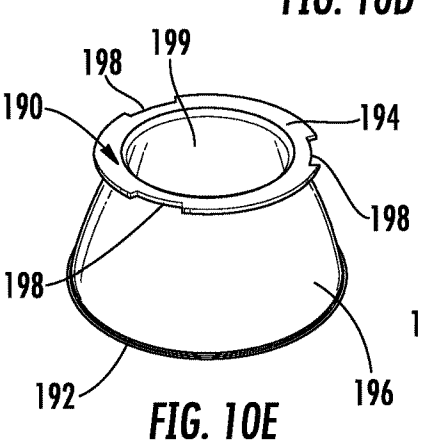
FIG. 10E
FIG. 10F

DOWNLIGHT LIGHTING ASSEMBLY

TECHNICAL FIELD

This disclosure relates to a downlight lighting assembly that is easily assembled and provides for mounting of either a round or square trim apertures.

BACKGROUND

Downlight lighting assemblies are typically installed in ceilings to illuminate a room. However, the assembly process particularly in a restricted space such as a ceiling can sometimes be cumbersome. As the assembly can be time consuming, an improvement to reduce the assembly time can help reduce the cost, while also reducing the possibility for assembly error. In addition, having a universal attachment method for installing a round or square trim member to the downlight lighting assembly can further reduce the assembly time required for installing a downlight lighting assembly.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to an LED downlight assembly that consists of a heat sink, the LED chip, the LED connector, the mixing chamber, the lens, and two screws to tie them all together. The LED downlight assembly creates a snap-fit engagement between the lens and the mixing chamber that allows for effortless assembly (and disassembly if necessary) between the lens and the mixing chamber. The mixing chamber may also have a snap-fit engagement on its backside that mates with the LED connector to hold it in place during assembly. When the LED chip and wires are in place on the LED connector and mixing chamber subassembly, two screws or securing members pass through the heat sink and LED connector to embed in the mixing chamber and create a sandwich-style compression engagement between the LED chip and the heat sink. Additional aspects relate to a twist and lock trim system that creates a universal attachment method for round and square trims. The twist and lock trim system is a frictional engagement between a slotted circular disk that is part of the trim. The twist and lock trim system also includes a ramp and "bayonet" feature that is tooled into the heat sink. As the trim is rotated, the "bayonet," or small bump, bites into the trim causing positive interference so that the trim is locked in place until the operator applies enough counter force to rotate the trim in the opposite direction, thereby releasing the engagement.

Further aspects of this invention relate to an LED downlight assembly that includes: an LED chip removably connected to a front surface of a rear wall of a heatsink and a mixing chamber. The heatsink further comprises a plurality of fins, a substantially cylindrical side wall extending from the front surface has at least one opening through the rear wall. The mixing chamber comprises at least one receiving member to receive a securing member and a lower engaging member extending from a rear surface that secures to an LED connector. The securing member is inserted through the at least one opening in the rear wall of the heatsink and into the receiving member of the mixing chamber. The LED connector is secured to the LED chip and the heatsink by a compressive force.

Additionally, further aspects of this invention relate to an LED downlight assembly that comprises: a heatsink, an LED chip located on the front surface of the heatsink, a mixing chamber, and a reflector. The heatsink may comprise a plurality of fins, a front surface of a rear wall, a substantially cylindrical side wall extending from the front surface, and a flange adjacent the cylindrical side wall opposite the front surface and a lip extending from the flange. The flange may include a plurality of slots. The lip may include a plurality of protrusions extending inward from an edge of the lip. The mixing chamber may comprise a central opening engaged to the heatsink. The reflector may have a circular wall with a central opening, a substantially conical shaped portion extending from the circular wall, and a plurality of notches positioned around an outside edge of the circular wall. The reflector may be secured to the heatsink by sliding the plurality of notches on the circular wall over the plurality of protrusions of the heatsink until the circular wall contacts a top surface of a mixing chamber and rotating the reflector such that at least one of the plurality of protrusions contacts the circular wall.

Additionally, further aspects of this invention relate to an LED downlight assembly that includes a heatsink, an LED chip located on a front surface of the heatsink, a mixing chamber, a reflector bracket, and a reflector. The heatsink may include a plurality of fins, a front surface of a rear wall, a substantially cylindrical side wall extending from the front surface, and a flange adjacent the cylindrical side wall opposite the front surface and a lip extending from the flange. The flange may include a plurality of slots. The lip may includes a plurality of protrusions extending inward from an edge of the lip. The mixing chamber may comprise a central opening engaged to the heatsink. The reflector bracket may comprise a substantially flat plate with a substantially circular profile, a central opening, and a plurality of notches in an outside edge of the circular profile. The reflector bracket may be secured to the heatsink by sliding the plurality of notches on the circular profile over the plurality of protrusions of the heatsink until the reflector bracket contacts a top surface of a mixing chamber and rotating the reflector bracket such that at least one of the plurality of protrusions contacts the reflector bracket.

The downlight lighting assembly may be similar to any of the previous downlight lighting assemblies described above or as described below and illustrated in the figures of this application.

BRIEF DESCRIPTION OF THE DRAWINGS

The present invention is illustrated by way of example and not limited in the accompanying figures in which like reference numerals indicate similar elements and in which:

FIGS. 10A-10F illustrate different reflectors for the downlight lighting assembly shown in FIG. 1;

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention.

The following terms are used in this specification, and unless otherwise noted or clear from the context, these terms have the meanings provided below.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Generally perpendicular" means that a first line, segment, plane, edge, surface, etc. is approximately (in this instance, within 5%) oriented approximately 90 degrees from another line, plane, edge, surface, etc., over at least 50% of the length of the first line, segment, plane, edge, surface, etc.

"Plurality" indicates any number greater than one, either disjunctively or conjunctively, as necessary, up to an infinite number.

"Substantially flat" means that the surface or component and any features upon the surface or component are equal to or less than 0.06 inches from either side of the surface or component.

Generally, this disclosure relates to a downlight lighting assembly or an LED downlight assembly that reduces assembly time and complexity for an LED downlight by using snap-fits and through-holes strategically. This assembly design reduces cost and simplifies the assembly process. The assembly also includes a universal attachment method for both round and square trims that is both robust and removable.

Figure 1:
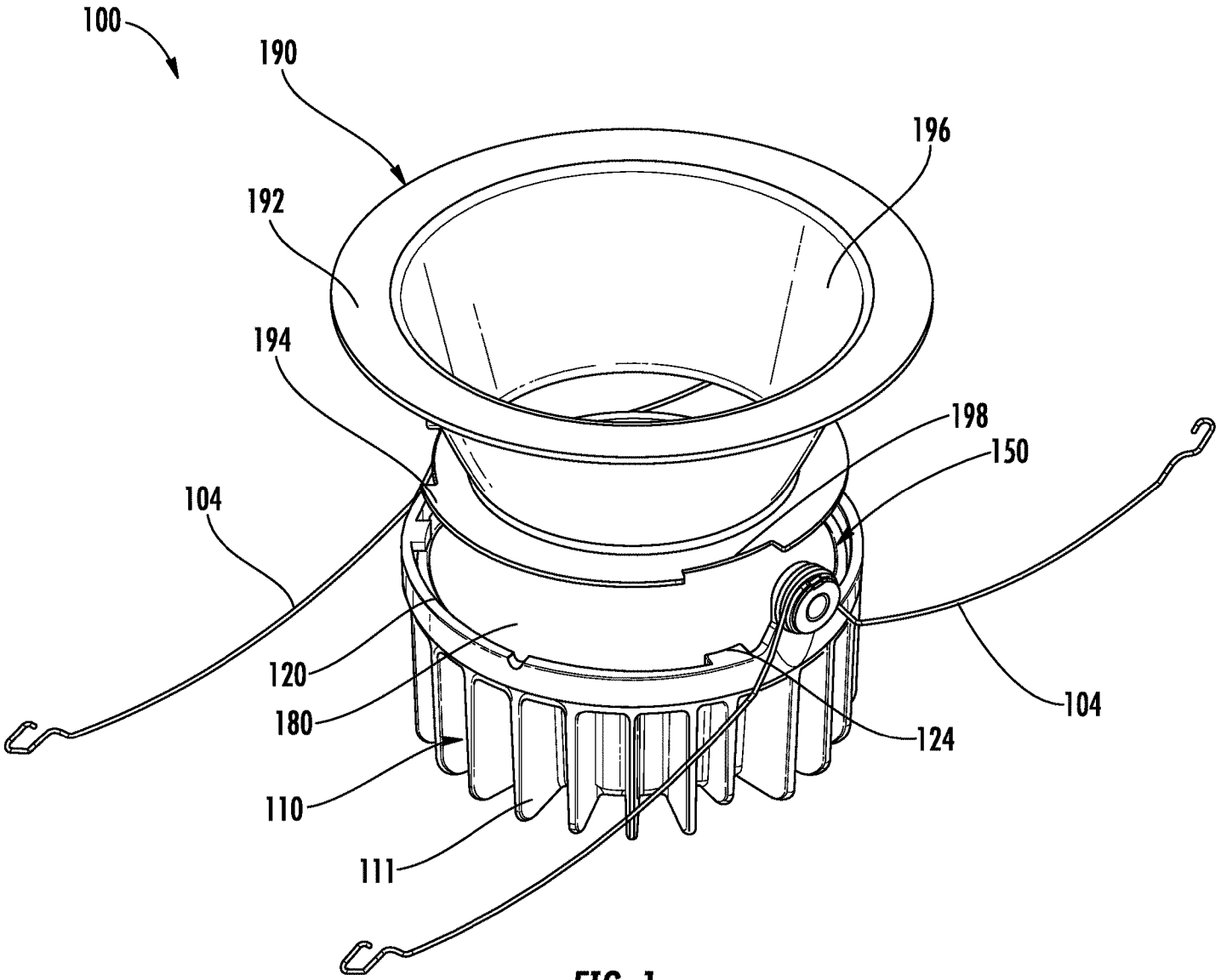
FIG. 1 illustrates a partially exploded view of an embodiment of the downlight lighting assembly as disclosed herein.
Figure 2A:
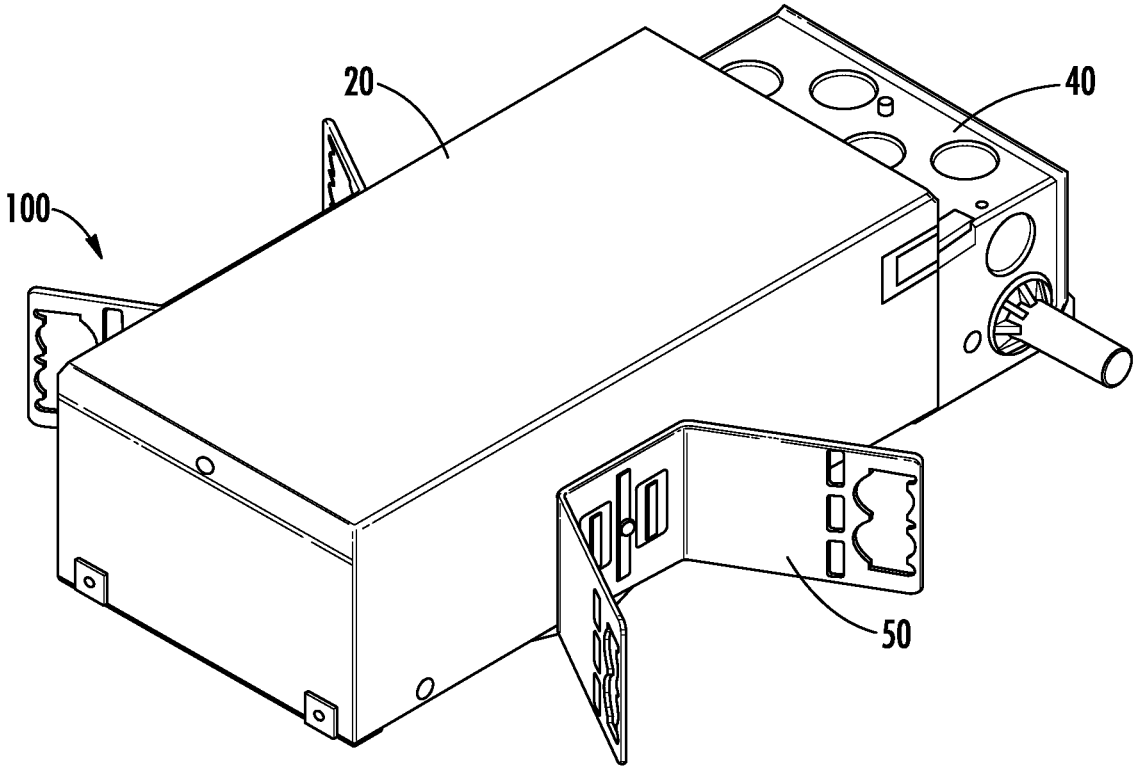
FIG. 2A illustrates a downlight lighting assembly enclosure with the housing.
Figure 2B:
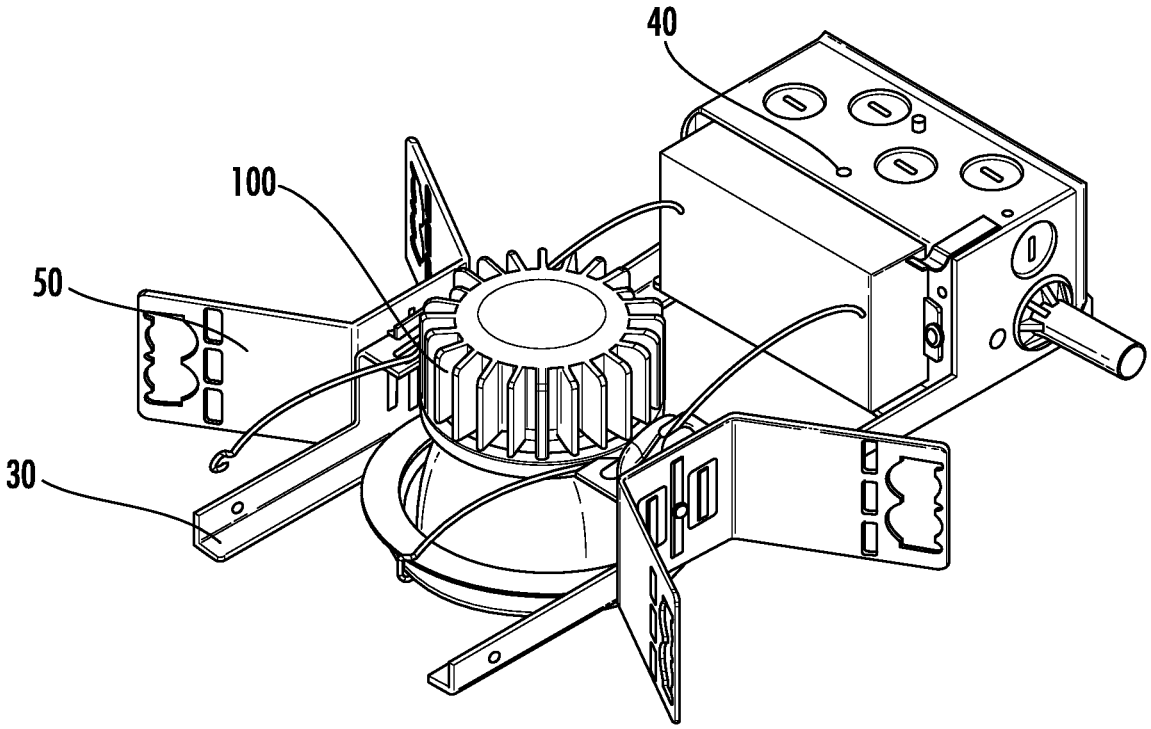
FIG. 2B illustrates a downlight lighting assembly with the housing removed.
Figure 3:
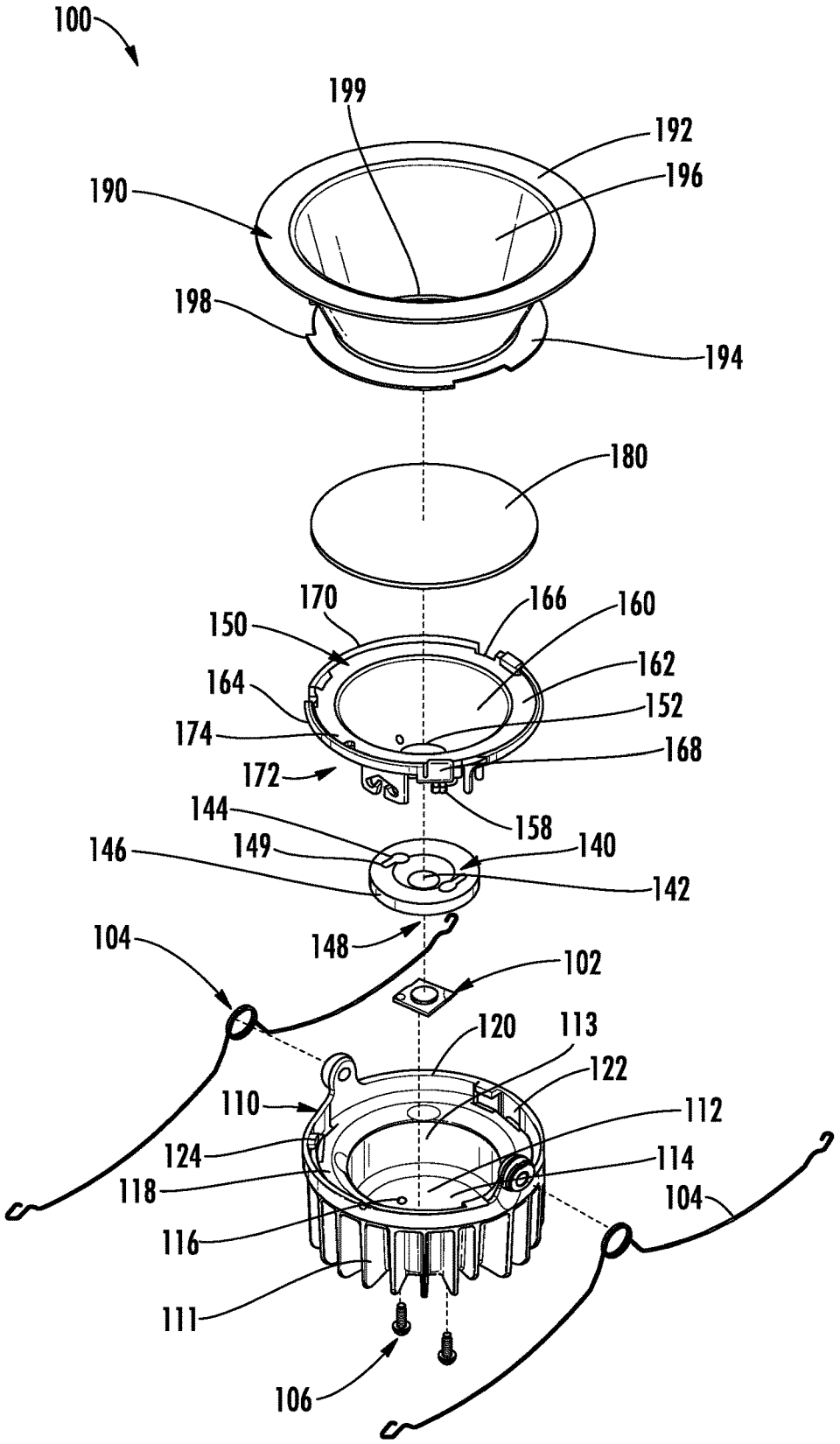
FIG. 3 illustrates a fully exploded view of the embodiment of the downlight lighting assembly shown in FIG. 1.
Figure 4:
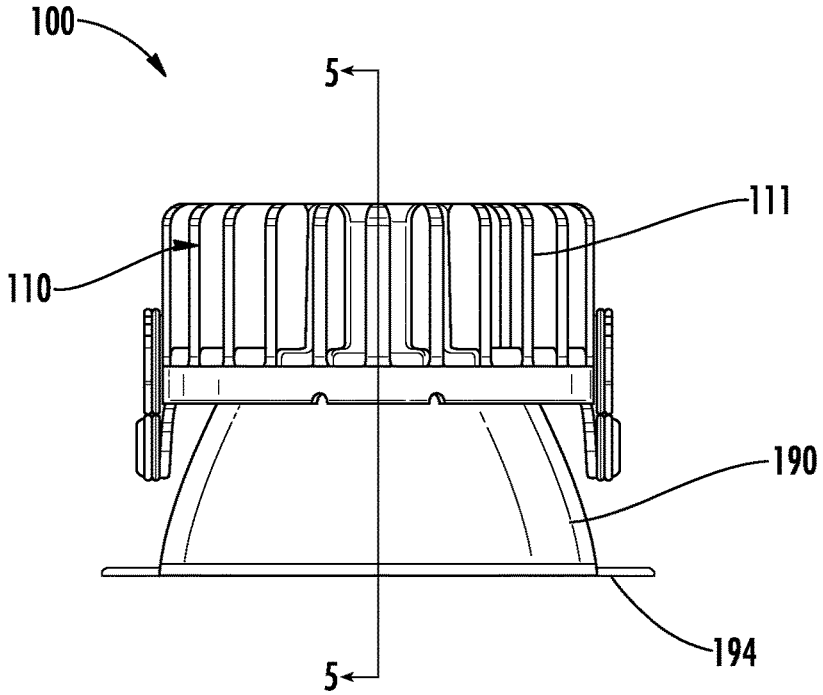
FIG. 4 illustrates a side view of the embodiment of the downlight lighting assembly shown in FIG. 1.
Figure 5:
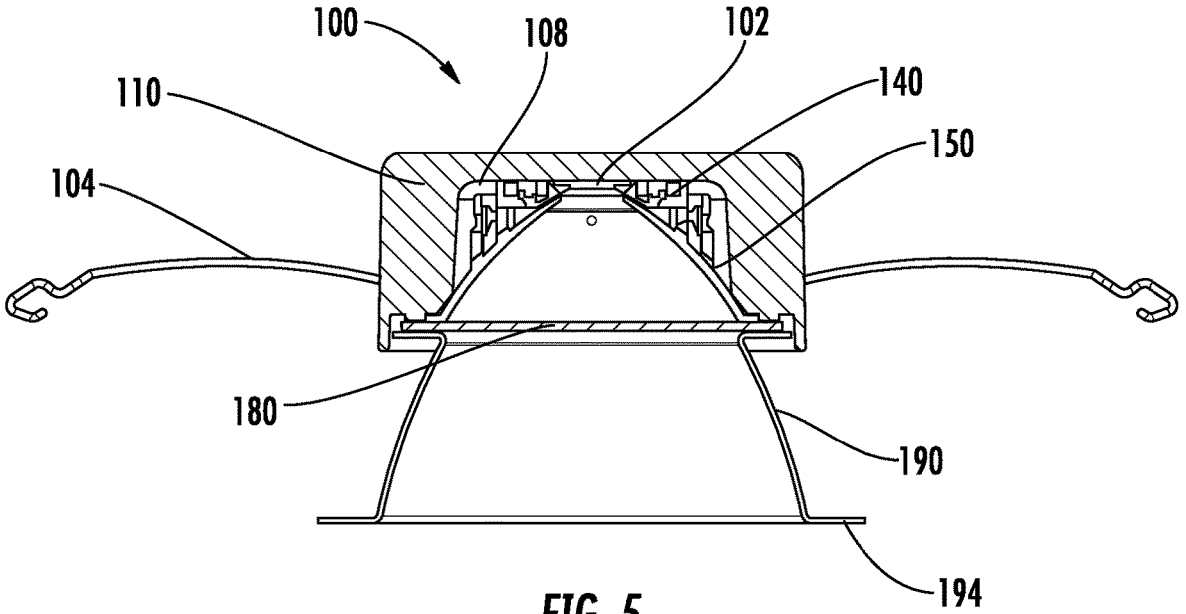
FIG. 5 illustrates a cross-sectional view taken along line 5-5 in FIG. 4.

As illustrated in FIGS. 1, 3, 4, and 5, the downlight lighting assembly 100 includes a heatsink 110, an LED chip 102, an LED connector 140, a mixing chamber 150, a diffusion lens 180, and a reflector 190. The downlight lighting assembly 100 may further comprise a plurality of torsion springs 104, and at least one securing member 106. As shown in FIGS. 3 and 5, the LED chip 102 may be removably connected to the heatsink 110. The LED connector 140 may be positioned on the LED chip 102. The mixing chamber 150 may be positioned on the LED connector 140 and may assist in aligning and securing the LED connector 140. The diffusion lens 180 may be positioned and held between the mixing chamber 150 and the reflector 190. The diffusion lens 180 may be a lens with substantially flat surfaces on both sides and a diffusion filter coating on at least one side. The heatsink 110 along with the mixing chamber 150 may secure the reflector 190 to the downlight lighting assembly 100. Additionally, FIGS. 2A and 2B show the downlight lighting assembly 100 in two of the possible mounting configurations. FIG. 2A illustrates the downlight lighting assembly 100 mounted in an enclosed housing 20. FIG. 2B illustrates the downlight lighting assembly 100 alternatively, mounted in an open frame type housing 30. Each configuration may include a power supply 40 along with mounting brackets 50 for the downlight lighting assembly 100.

As shown in FIGS. 3, 4, and 5, the heatsink 110 may have a generally cylindrical external shape and comprise a plurality of fins 111 to help dissipate the heat generated from the LED chip 102. The LED chip 102 may be connected to the heatsink 110 and more specifically, the LED chip 102 may be connected to a front surface 114 of a rear wall 112 of the heatsink 110. The heatsink 110 may also comprise a substantially cylindrical interior side wall 113 extending from the front surface 114 and at least one opening 116 through the rear wall 112. The heatsink 110 may have a flange 118 and a lip 120 extending from the flange 118. The heatsink 110 may align the mixing chamber 150 to the proper orientation. To align and help secure the mixing chamber 150 to the heatsink 110, a plurality of slots 122 may extend through the flange 118. The plurality of slots 122 may be positioned uniformly or non-uniformly around the heatsink 110. The heatsink 110 may also include a plurality of protrusions 124 positioned around the perimeter of the lip 120 that are adjacent to the plurality of slots 122 on the heatsink 110. Similar to the slots 122, the plurality of protrusions 124 may be positioned uniformly or non-uniformly around the heatsink 110.

Figure 6:
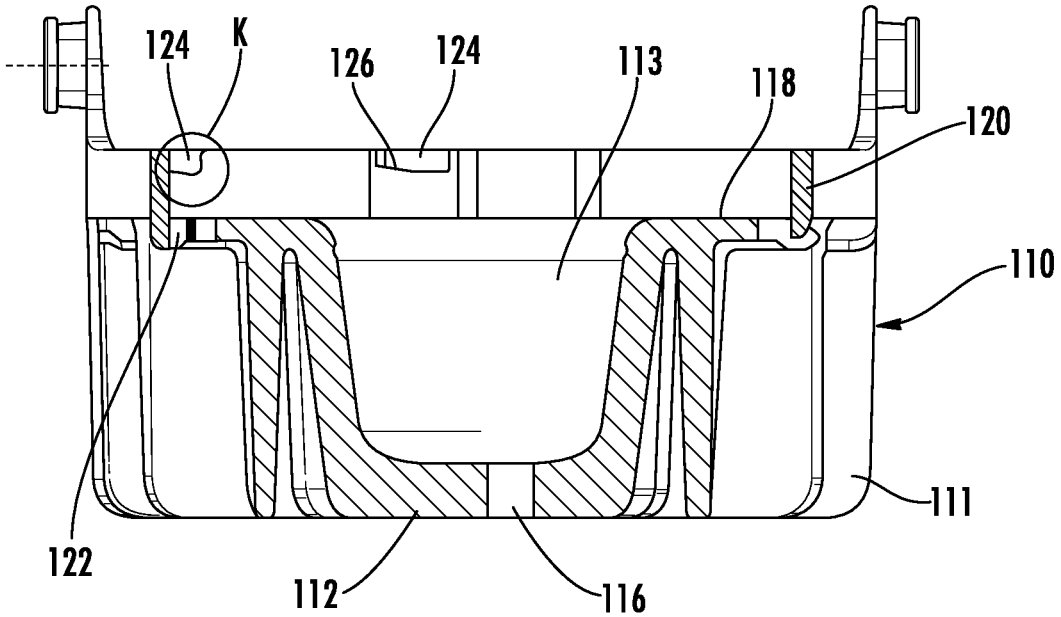
FIG. 6 illustrates a cross-sectional view of the heatsink of the downlight lighting assembly shown in FIG. 1 with the other components removed.

As shown in FIG. 6, the heatsink 110 may have engaging features to help secure the reflector 190. More specifically, the protrusions 124 may create an undercut between the bottom surface 126 of the protrusion 124 to help secure the reflector 190. The protrusion 124 that forms the undercut may have a bottom surface 126, where the bottom surface 126 has a portion that comprises an angled surface or taper.

Figure 7:
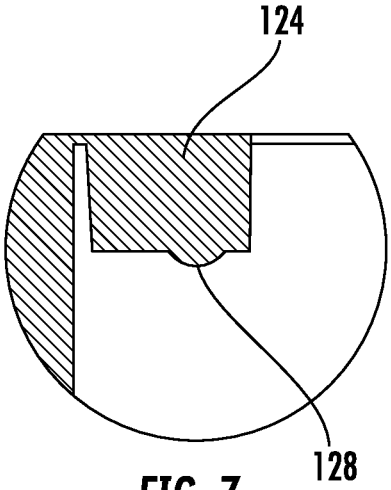
FIG. 7 illustrates a detailed view of a portion of the heatsink from FIG. 6.

The angle on the bottom surface 126 may assist in allowing a bottom wall 194 of the reflector 190 to rotate under the protrusion 124. In addition to the taper on the bottom surface 126 of the protrusion 124, the protrusion 124 may also have a bayonet or small bump 128 that engages the bottom wall 194, as shown in more detail in FIG. 7. The bump 128 on the protrusion 124 may create a positive interference so that the reflector 190 can be locked into place until an operator applies enough counter force to rotate the reflector 190 in the opposite direction to release the engagement.

As illustrated in FIG. 3, the LED connector 140 may be positioned on top of the LED chip 102. The LED connector 140 may have a central opening 142 to allow the light to pass through the LED connector 140. The LED connector 140 may also include a top surface 144, a side surface 146, and a bottom surface 148. The bottom surface 148 may secure the electrical connectors (not shown) for the LED chip 102. The side surface 146 may provide holes (not shown) for inserting a wiring harness (not shown). To provide the electrical connection to the LED chip 102, the bottom surface 148 of the LED connector 140 may contact the LED chip 102 to allow electrical connectors secured on the LED connector 140 to contact the designated areas on the LED chip 102 to provide adequate power to the LED chip 102. The LED connector 140 may further provide the necessary alignment of the electrical connectors to successfully engage the LED chip 102. The LED connector 140 may be secured to the LED chip 102 and the heatsink 110 by a compressive force. For example, securing the mixing chamber 150 to the heatsink 110 may provide the compressive force for the LED connector 140 to engage and provide the electrical connection to the LED chip 102.

As illustrated in FIGS. 1, 3, 4, 5, 8, and 9, the mixing chamber 150 may be positioned on the LED connector 140 and may assist in aligning and securing the LED connector 140. The mixing chamber 150 may have at least one receiving member 154 extending from a rear surface 156. The receiving member 154 is configured to receive a securing member 106 such as a mechanical fastener. Additionally, a plurality of lower engaging members 158 may engage corresponding openings 149 on the LED connector 140 to align and secure the mixing chamber 150 to the LED connector 140. The mixing chamber 150 may have a central opening 152 to allow the light from the LED chip 102 to pass through the opening 152. The mixing chamber 150 may also may have a reflecting surface 160 that helps to shape the light to match the desired needs.

For the embodiment shown in FIGS. 1-10, the mixing chamber 150 may have a round or parabolic shaped reflecting surface 160, which helps to shape the light coming from the LED chip 102 to correspond with a round or circular shaped trim. A flange 162 may be positioned at the top of the mixing chamber 150 with a lip 164 extending from the flange 162. To align and engage the heatsink 110, a plurality of slots 166 may extend through both the lip 164 and a portion of the flange 162. Additionally, a plurality of upper engaging members 168 may be positioned adjacent the slots 166 to engage and secure a diffusion lens 180. The plurality of slots 166 and the plurality of upper engaging members 168 may be positioned uniformly around the mixing chamber 150. The upper engaging members 168 may form a snap-fit engagement or connection to secure the diffusion lens 180 to a top surface 174 of the flange 162. The upper engaging members 168 may extend beyond a top surface 170 of the lip 164 and also extend below a bottom surface 172 of the flange 162. The upper engaging members 168 may have a bayonet style feature, which features a small extension to secure the diffusion lens 180 in place. The lip 164 may also align and secure the diffusion lens 180 to keep the diffusion lens 180 from moving horizontally while the upper engaging members 168 secure the diffusion lens 180 from moving vertically.

To align and help secure the mixing chamber 150 to the heatsink 110, the plurality of slots 122 of the heatsink 110 may extend through the flange 118 of the heatsink. The portion of each of the upper engaging members 168 that extends below the bottom surface 172 of the flange 162 of the mixing chamber 150 may extend into the slots 122 of the heatsink. Similar to the upper engaging members 168 of the mixing chamber 150, the plurality of slots 122 may be positioned uniformly or non-uniformly around the heatsink.

The heatsink 110 may align the mixing chamber 150 to the proper orientation. When installing the mixing chamber 150, the plurality of slots 166 may slide over a plurality of protrusions 124 that are adjacent the plurality of slots 122 on the heatsink 110 until the bottom surface 172 of the flange 162 of the mixing chamber 150 contacts the flange 118 of the heatsink 110. The protrusions 124 may create an undercut between the bottom surface 126 of the protrusion 124 to help secure the reflector 190.

Figure 8:
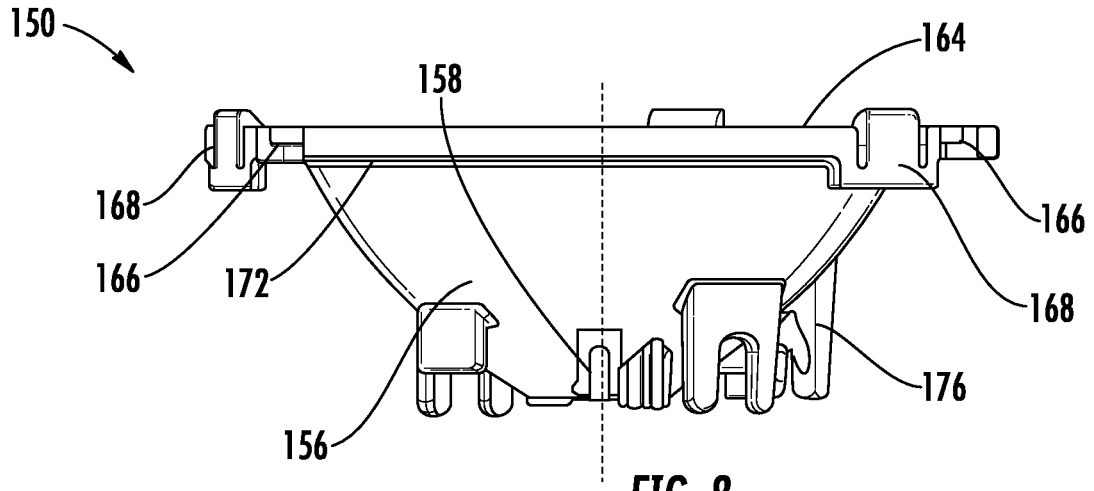
FIG. 8 illustrates a side view of the mixing chamber of the downlight lighting assembly shown in FIG. 1 with the other components removed.
Figure 9:
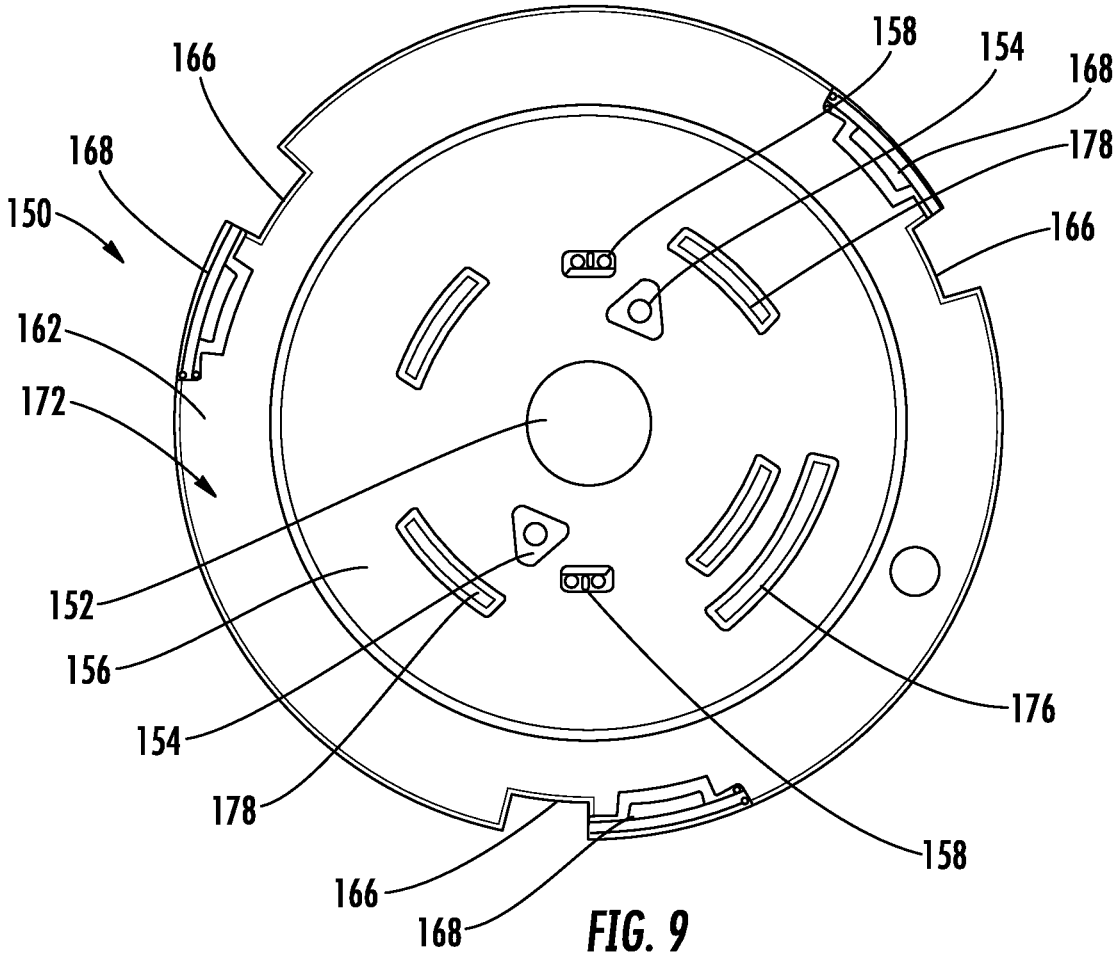
FIG. 9 illustrates a bottom view of the mixing chamber of the downlight lighting assembly shown in FIG. 1 with the other components removed.

FIGS. 8 and 9 show views of the mixing chamber 150 without the other components. The plurality of lower engaging members 158 extending from the rear surface 156 may have two prongs that can engage the openings 149 on the LED connector 140. The plurality of lower engaging members 158 may comprise two engaging members that are equally spaced apart, which can both engage the corresponding openings 149 of the LED connector 140. While the embodiment shown in FIGS. 8 and 9 illustrates two engaging members 158, the number of engaging members 158 may comprise any number of engaging members such as a single engaging member 158, three engaging members 158, four engaging members 158, or more engaging members 158. Additionally, the receiving members 154 may be generally triangular in shape and have an aperture for receiving a securing member, such as a mechanical fastener. The number of receiving members 154 may have any number of receiving members 154, such as a single receiving member, two receiving members as shown in FIG. 9, or three receiving members, or more receiving members. The number of securing members 106 may correspond to the number of receiving members 154. The receiving members 154 may be equally spaced apart, or alternatively may be unequally spaced apart.

As further illustrated in FIGS. 8 and 9, the mixing chamber 150 may include a wire retainer 176 and a plurality of wire guides 178 in order to secure a wiring harness. The wire retainer 176 and plurality of wire guides 178 may also extend from the rear surface 156 of the mixing chamber 150. The wire retainer 176 may have a hook or U-shaped feature to retain a wiring harness. The plurality of wiring guides 178 may have a slot to allow a wiring harness to exit the LED connector 140 in the opening created by the slot. Further as the wiring harness wraps around the wiring guide 178, the thickness of the wiring guide 178 may keep the wiring harness from having too small of a radius as to not damage the wire. The wiring guides 178 may be spaced to engage the openings on the side surface 146 of the LED connector 140, while the wire retainer 176 may be positioned away from the wiring guides 178 near a wiring opening in the heatsink 110.

The reflector 190 may have a top wall 192, a bottom wall 194, and a generally conical or generally parabolic shaped surface 196 between the top and bottom walls 192, 194 with a circular central opening 199 through the reflector 190. The bottom wall 194 may have a circular shape and a plurality of notches 198 extending through the outside edge of bottom wall 194. The top wall 192 may form the exterior trim member that is visible to the user. To secure the reflector 190 to the heatsink 110, the plurality of notches 198 on the bottom wall 194 may be slid over the plurality of protrusions 124 of the heatsink 110 until the bottom wall 194 contacts a top surface 170 of the mixing chamber 150. An operator may rotate the reflector 190 such that the bottom wall 194 slides underneath at least one of the plurality of protrusions 124 until the contact with the bottom wall 194 creates a frictional engagement to secure the reflector 190 to the heatsink 110.

FIGS. 10A-F illustrates several different styles of circular style reflectors 190 for the downlight lighting assembly 100. For instance, FIGS. 10A-10C show varieties of reflectors 190 having an overlap trim, where the top wall 192 constitutes an exterior trim that is visible when the lighting assembly is installed. While FIGS. 10D-10F illustrate reflectors that are "trimless" to have a seamless appearance at the wall, where the top wall 192 is the thickness of the wall having the parabolic shaped surface 196.

Figure 11:
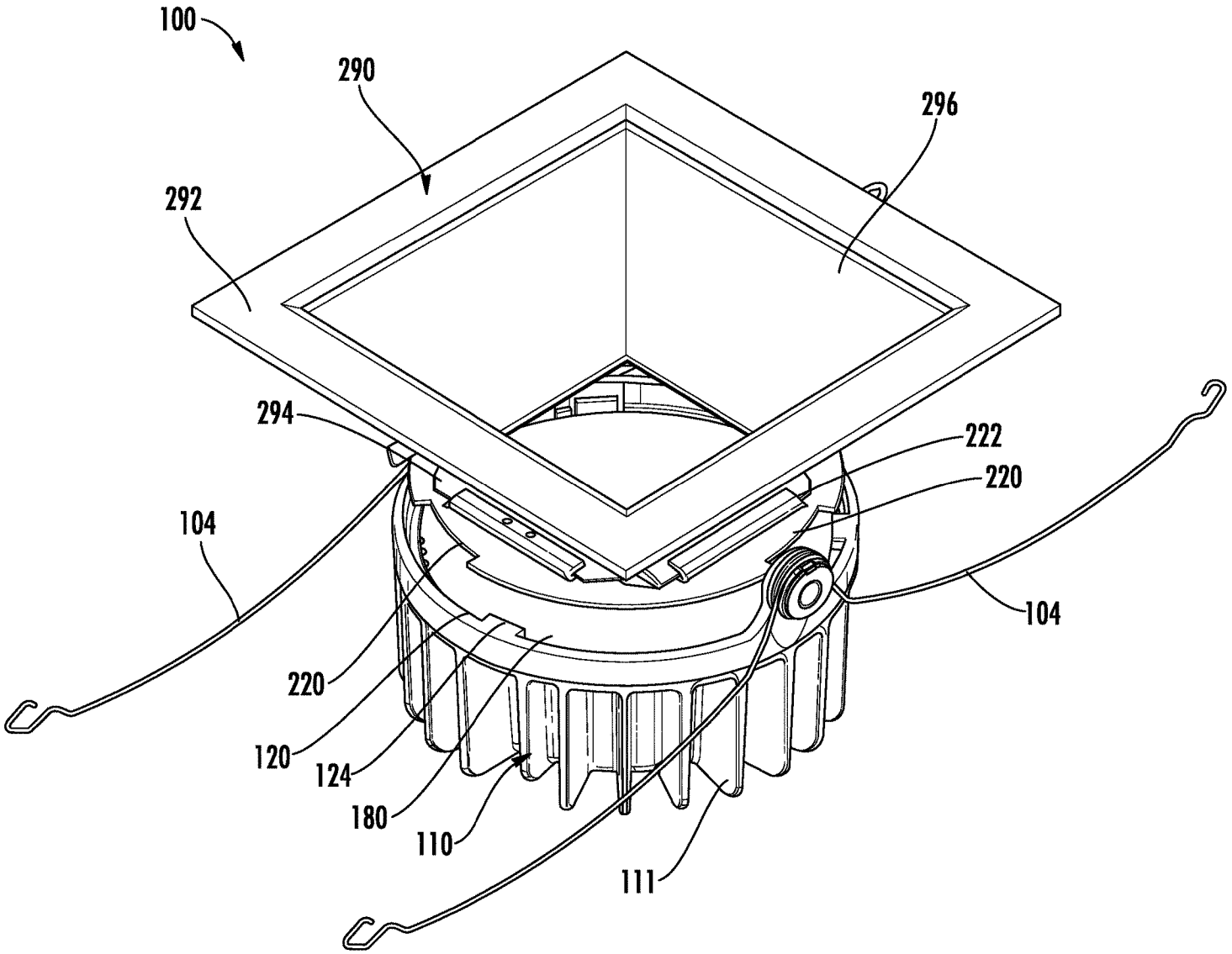
FIG. 11 illustrates partially exploded view of an alternate embodiment of the downlight lighting assembly.
Figure 12:
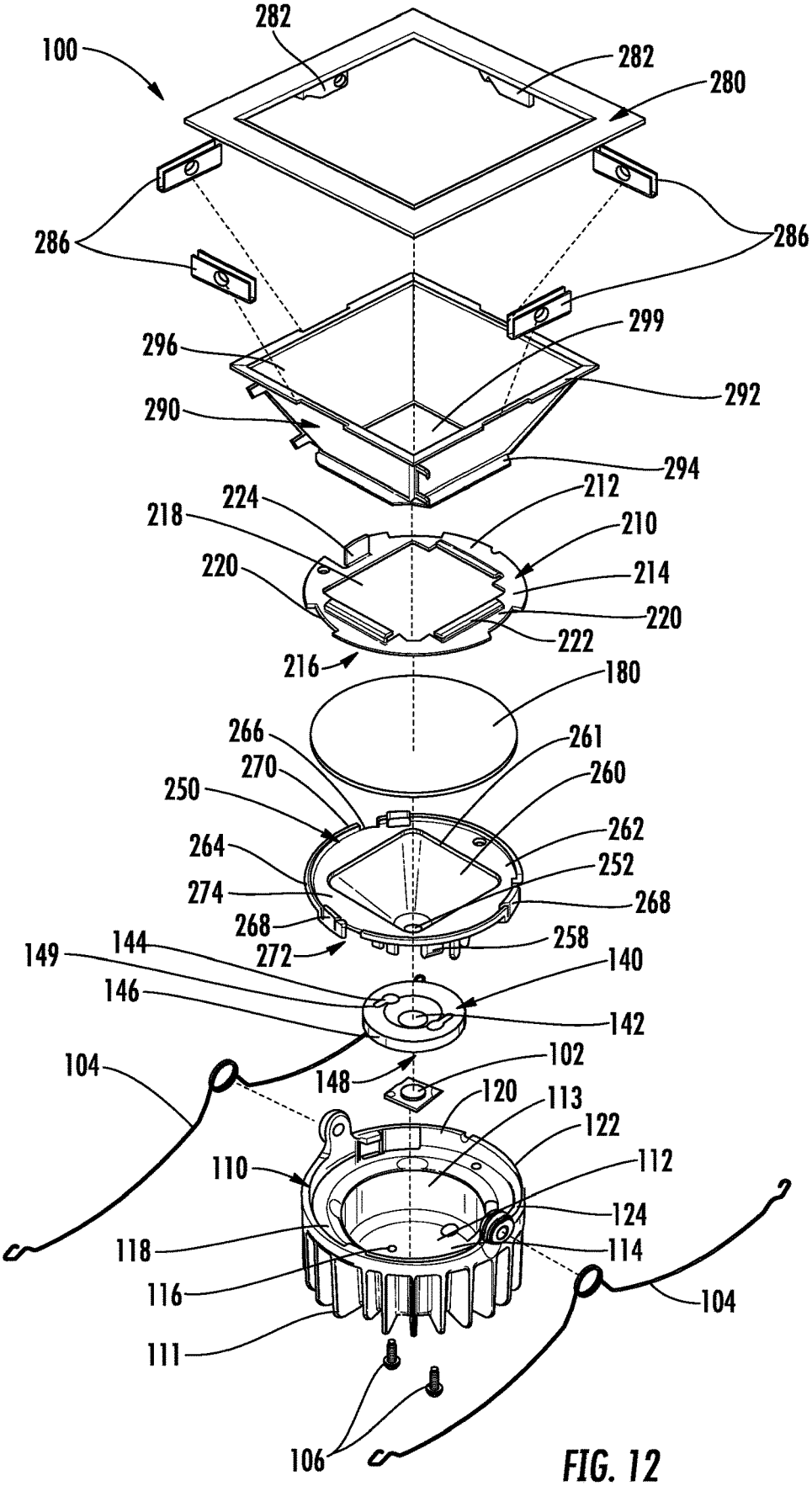
FIG. 12 illustrates a fully exploded view of the alternate embodiment shown in FIG. 11.
Figure 13:
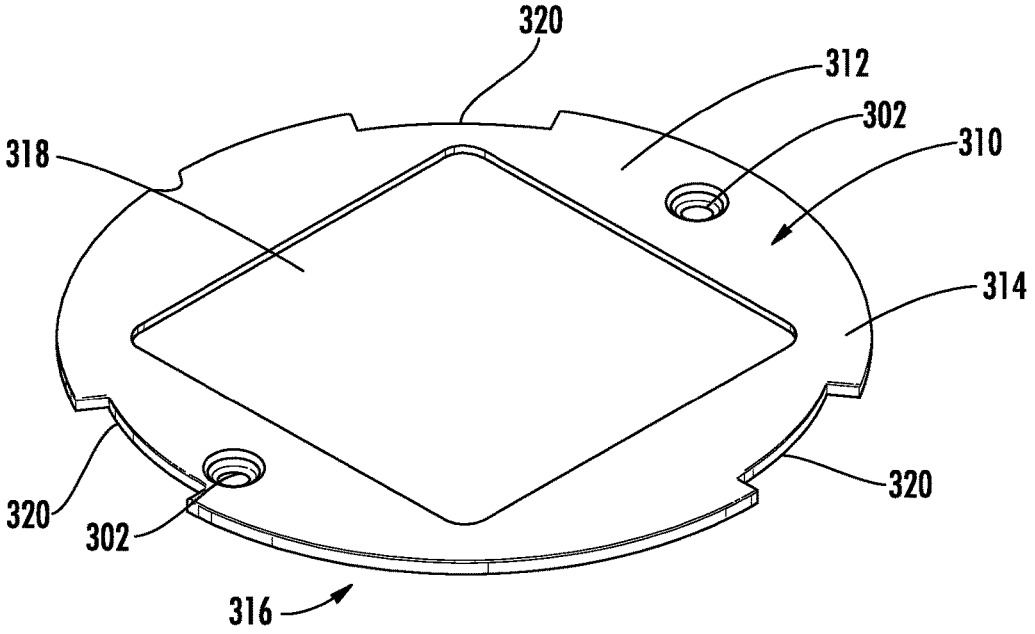
FIG. 13 illustrates an alternate reflector bracket for the downlight lighting assembly of FIG. 11 with the other components removed.

FIGS. 11-13 illustrate an alternate embodiment for the downlight lighting assembly 100 where the reflector assembly 290 has a substantially square cross-sectional shape and. For the embodiment shown in FIGS. 11-13, the circular cross-section reflector 190 as shown in FIGS. 1 and 3-10 is replaced by a square cross-section shaped reflector assembly 290, which uses a reflector bracket 210 between to the reflector assembly 290 and the heatsink 110 to secure the reflector assembly 290 to the downlight lighting assembly 100.

As shown in FIGS. 11 and 12, the heatsink 110, the LED connector 140, and the LED chip 102 remain the same as described above. The mixing chamber 250 may have all of the similar features as the mixing chamber 150 described above, but may use the reference numbers 25X, 26X, and 27X which may correspond to features having reference numbers 15X, 16X, and 17X of the mixing chamber 150, which may be described in less or no further detail than described above. The primary difference between the mixing chamber 150 and the mixing chamber 250 is that the shape of the reflecting surface 260 may have a substantially square upper edge 261. The reflecting surface 260 may smoothly transition from the circular central opening 152 to the square upper edge 261. The square upper edge 261 may have four substantially straight edges connected by four smooth radii at the corners.

The reflector bracket 210 may help connect the heatsink 110 to the reflector assembly 290. The reflector bracket 210 may comprise a substantially flat plate 212 with a substantially circular outer profile having a top surface 214 and a bottom surface 216, a substantially square central opening 218, and a plurality of notches 220 in an outside edge of the circular outer profile. To secure the reflector bracket 210 to the heatsink 110, the plurality of notches 220 may be slid over the plurality of protrusions 124 of the heatsink 110 until the bottom surface 216 of the reflector bracket 210 contacts a top surface 270 of a mixing chamber 250. When the bottom surface 216 contacts the top surface 270, an operator may rotate the reflector bracket 210 such that at least one of the plurality of protrusions 124 contacts the top surface 214 of the reflector bracket 210. Thus, securing the reflector bracket 210 to the heatsink 110. Similar to the process described above, the bump 128 on the protrusion 124 may create a positive interference so that the reflector bracket 210 can be locked into place until an operator applies enough counter force to rotate the reflector bracket 210 in the opposite direction to release the engagement.

Additionally, the reflector bracket 210 may have features to engage and secure the reflector assembly 290. The reflector bracket 210 may have a plurality of flanges 222 that are offset from the top surface 214 and adjacent on at least two edges of the substantially square central opening 218. The flanges 222 may be adjacent to at least three edges of the substantially square central opening 218. The reflector bracket 210 may further comprise a tab 224 adjacent one of the edges of the square central opening 218 without a flange 222.

The reflector bracket 210 may secure the reflector assembly 290 having square shaped end portions. The reflector assembly 290 may have an upper surface 292, a lower surface 294, and a plurality of planar surfaces 296 extending between the lower surface 294 and the upper surface 292, where the planar surfaces 296 have a square-shaped cross-section. In addition, the reflector assembly may have a substantially square central opening 299. For instance, the plurality of planar surfaces 296 may form a truncated pyramidal shape. The reflector assembly 290 may be secured to the reflector bracket 210 by sliding the lower surface 294 under the plurality of flanges 222 and a user may bend the tab 224 to contact the reflector assembly 290. Depending upon the desired exterior trim required, a trim member 280 may be connected to the upper surface 292 of the reflector assembly 290 via a plurality of trim insert clips 286 that engage a plurality of tabs 282 extending from the trim member 280.

Figure 14:
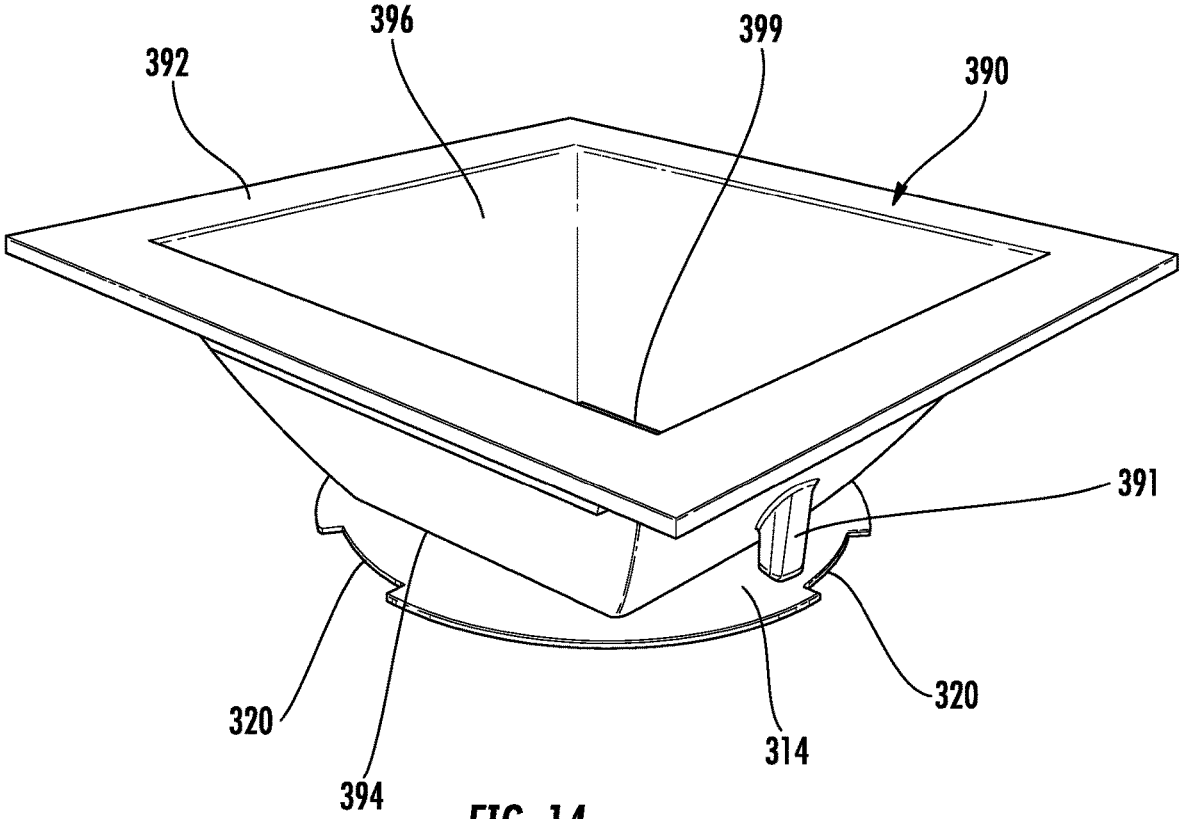
FIG. 14 illustrates an alternate reflector and alternate reflector bracket for the downlight lighting assembly of FIG. 11 with the other components removed.

Another alternate embodiment of a substantially square shaped reflector for the downlight lighting assembly 100 is shown in FIGS. 13 and 14. FIG. 13 illustrates another alternate reflector bracket 310 that may secure a reflector 390 that can replace the reflector bracket 210 and reflector assembly 290. Reflector bracket 310 comprises a substantially flat plate 312 with a substantially circular outer profile having a top surface 316 and a bottom surface 314, a substantially square central opening 318, and a plurality of notches 320 in an outside edge of the circular outer profile. The plurality of notches 320 have similar properties to the notches 198 of reflector 190 as well as the notches 220 of reflector bracket 310. The reflector bracket 310 may be secured to the heatsink 110 in a similar manner to the reflector bracket 210. The plurality of notches 320 may be slid over the plurality of protrusions 124 of the heatsink 110 until the bottom surface 314 of the reflector bracket 310 contacts a top surface 270 of a mixing chamber 250. The reflector bracket 310 may be rotated such that at least one of the plurality of protrusions 124 on the heatsink 110 contacts the top surface 316 of the reflector bracket 310. Thus, securing the reflector bracket 310 and the reflector 390 to the heatsink 110.

To secure the reflector 390 to the reflector bracket 310, the reflector bracket 310 may further include a plurality of smaller openings 302. The openings 302 may be circular holes with a countersink feature on the bottom surface 314. A securing member (not shown) may extend through the openings 302 into one of a plurality of receivers 391 on the reflector 390, as shown on FIG. 14, to secure the reflector bracket 310 to the reflector 390. The reflector 390 may further comprise an upper surface 392, a lower surface 394, and a plurality of planar surfaces 396 extending between the lower surface 394 and the upper surface 392, and a square shaped central opening 399. Similar to the reflector assembly 290, the plurality of planar surfaces 396 of the reflector 390 may have a substantially square shaped cross-section. The square shaped upper surface 392 may act as a visible exterior trim member.

The components described above may be manufactured using conventional means and materials. For instance, the heatsink 110, reflectors 190, 290, 390, reflector brackets 210, 310, and torsion springs 104 may be formed from a metallic material, such as an aluminum alloy, steel alloy, copper alloy, or other metallic material. The metallic components of the heatsink 110 and reflector 390 may be formed from near net shape manufacturing process, such as a casting process, such as die casting, permanent mold casting, or investment casting. Furthermore, the metallic components such as the reflector brackets 210, 310 may be formed using a sheet metal forming process. Additional machining operations may be performed to finalize the components. Alternatively, the components may be fully machined or formed using an additive manufacturing process.

In addition, the LED connector 140, mixing chambers 150, 250, and the diffusion lens 180 may be formed of non-metallic materials, such as a polymer based material, such as a polycarbonate, nylon, acrylic, or other non-metallic materials. These non-metallic components may be formed from an injection molding type process or with additional machining operations to finalize the components. Alternatively, the components may be fully machined or formed using an additive manufacturing process.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. An LED downlight assembly comprising:

an LED chip removably connected to a front surface of a rear wall of a heatsink, wherein the heatsink further comprises a plurality of fins, a substantially cylindrical side wall extending from the front surface has at least one opening through the rear wall;

an LED connector positioned over the LED chip including a central opening for the LED chip; and a mixing chamber secured to the heatsink and comprising at least one receiving member to receive a securing member, the mixing chamber further including a plurality of lower engaging members extending from a rear surface of the mixing chamber that engage a corresponding plurality of openings on the LED connector to align and secure the mixing chamber to the LED connector, wherein the securing member extends through the at least one opening in the rear wall of the heatsink and into the at least one receiving member of the mixing chamber, and further wherein securing the mixing chamber to the heatsink provides a compressive force for the LED connector to engage and provide an electrical connection to the LED chip.

2. The LED downlight assembly of claim 1, wherein the mixing chamber includes two receiving members for two securing members.

3. The LED downlight assembly of claim 1, wherein the plurality of lower engaging members forms a snap-fit engagement with the LED connector.

4. The LED downlight assembly of claim 1, wherein the securing member is a mechanical fastener.

5. The LED downlight assembly of claim 1, wherein the LED connector engages with a wiring harness, and wherein the mixing chamber has a wire retainer extending from the rear surface to secure the wiring harness.

6. The LED downlight assembly of claim 1, wherein the mixing chamber further comprises a flange surrounded by a lip, a plurality of notches extending through a portion of the flange, and a plurality of upper engaging members, wherein the plurality of upper engaging members have a portion that extends above a top surface of the flange and have a portion extending below a bottom surface of the flange.

7. The LED downlight assembly of claim 6, wherein the heatsink further comprises a flange having a plurality of slots extending through the flange, and wherein the portion of the plurality of the upper engaging members extending below the bottom surface of the flange of the mixing chamber extend into the plurality of slots on the flange of the heatsink.

8. The LED downlight assembly of claim 6, further comprising a diffusion lens secured to the mixing chamber by the plurality of upper engaging members of the mixing chamber.

9. An LED downlight assembly comprising:

a heatsink comprising a plurality of fins, a front surface of a rear wall, a substantially cylindrical side wall extending from the front surface, and a flange adjacent the cylindrical side wall opposite the front surface and a lip extending from the flange, wherein the flange includes a plurality of slots and the lip includes a plurality of protrusions extending inward from an edge of the lip;

an LED chip located on the front surface of the heatsink;

an LED connector positioned over the LED chip including a central opening for the LED chip;

a mixing chamber secured to the heatsink and comprising a central opening engaged to the heatsink; and a reflector having a circular wall with a central opening, a substantially conical shaped portion extending from the circular wall, and a plurality of notches positioned around an outside edge of the circular wall, wherein the reflector is secured to the heatsink by sliding the plurality of notches on the circular wall over the plurality of protrusions of the heatsink until the circular wall contacts a top surface of a mixing chamber and rotating the reflector such that at least one of the plurality of protrusions contacts the circular wall, wherein securing the mixing chamber to the heatsink provides a compressive force for the LED connector to engage and provide an electrical connection to the LED chip.

10. The LED downlight assembly of claim 9, wherein each of the protrusions have an angled portion on a bottom surface.

11. The LED downlight assembly of claim 9, wherein each of the protrusions has a bump on a bottom surface.

12. The LED downlight assembly of claim 9, wherein each protrusion has an angled portion on a bottom surface and a bump on the bottom surface.

13. The LED downlight assembly of claim 9, wherein a number of the plurality of protrusions are equally spaced around a perimeter of the lip of the heatsink.

14. An LED downlight assembly comprising:

a heatsink comprising a plurality of fins, a front surface of a rear wall, a substantially cylindrical side wall extending from the front surface, and a flange adjacent the cylindrical side wall opposite the front surface and a lip extending from the flange, wherein the flange includes a plurality of slots and the lip includes a plurality of protrusions extending inward from an edge of the lip;

an LED chip located on a front surface of the heatsink;

an LED connector positioned over the LED chip including a central opening for the LED chip;

a mixing chamber secured to the heatsink comprising a central opening engaged to the heatsink, the mixing chamber further including a plurality of lower engaging members extending from a rear surface of the mixing chamber that engage a corresponding plurality of openings on the LED connector to align and secure the mixing chamber to the LED connector; and a reflector bracket comprising a substantially flat plate with a substantially circular profile, a central opening, and a plurality of notches in an outside edge of the circular profile, wherein the reflector bracket is secured to the heatsink by sliding the plurality of notches on the circular profile over the plurality of protrusions of the heatsink until the reflector bracket contacts a top surface of a mixing chamber and rotating the reflector bracket such that at least one of the plurality of protrusions contacts the reflector bracket, wherein securing the mixing chamber to the heatsink provides a compressive force for the LED connector to engage and provide an electrical connection to the LED chip.

15. The LED downlight assembly of claim 14, further comprising a reflector assembly connected to the reflector bracket, wherein the reflector assembly has end portions that are square in shape.

16. The LED downlight assembly of claim 15, wherein the central opening of the reflector bracket is substantially square in shape.

17. The LED downlight assembly of claim 14, wherein the mixing chamber comprises at least one receiving member to receive a securing member, wherein the securing member is inserted through an opening in the rear wall of the heatsink and into the at least one receiving member of the mixing chamber securing the LED connector and the mixing chamber to the heatsink.

18. The LED downlight assembly of claim 14, wherein each of the protrusions have an angled portion on a bottom surface.

19. The LED downlight assembly of claim 14, wherein each of the protrusions has a bump on a bottom surface.

20. The LED downlight assembly of claim 14, wherein the mixing chamber comprises a wire retainer and a plurality of wire guides for routing a wiring harness.

* * * * *